US008201533B2

(12) United States Patent
Fujii et al.

(10) Patent No.: US 8,201,533 B2
(45) Date of Patent: Jun. 19, 2012

(54) LASH ADJUSTER AND VALVE APPARATUS

(75) Inventors: Hiroki Fujii, Aichi-ken (JP); Kikuya Ichiishi, Aichi-ken (JP)

(73) Assignee: OTICS Corporation, Nishio-shi (JP)

( * ) Notice: Subject to any disclaimer, the term of this patent is extended or adjusted under 35 U.S.C. 154(b) by 808 days.

(21) Appl. No.: 12/144,034

(22) Filed: Jun. 23, 2008

(65) Prior Publication Data

US 2009/0020088 A1 Jan. 22, 2009

(30) Foreign Application Priority Data

Jul. 3, 2007 (JP) ..... 2007-175032

(51) Int. Cl.
*F01L 1/14* (2006.01)

(52) U.S. Cl. ..... 123/90.55; 123/90.36; 123/90.43

(58) Field of Classification Search ..... 123/90.43, 123/90.45, 90.46, 90.55, 90.56, 90.57, 90.58, 123/90.59, 90.12, 90.37, 90.52, 90.53, 90.54, 123/90.33, 90.35, 90.36
See application file for complete search history.

(56) References Cited

U.S. PATENT DOCUMENTS

| | | | | |
|---|---|---|---|---|
| 2,870,757 | A * | 1/1959 | Dayton | 123/90.19 |
| 5,129,373 | A * | 7/1992 | Cuatt et al. | 123/90.55 |
| 5,622,147 | A * | 4/1997 | Edelmayer | 123/90.35 |
| 5,704,319 | A * | 1/1998 | Engelhardt et al. | 123/90.55 |
| 5,855,191 | A * | 1/1999 | Blowers et al. | 123/90.36 |
| 5,862,785 | A * | 1/1999 | Blowers et al. | 123/90.43 |
| 5,901,676 | A * | 5/1999 | Edelmayer | 123/90.35 |
| 6,006,710 | A * | 12/1999 | Stephan | 123/90.43 |
| 6,039,017 | A * | 3/2000 | Hendriksma | 123/90.43 |
| 7,644,693 | B2 * | 1/2010 | Cecur | 123/90.52 |

FOREIGN PATENT DOCUMENTS

| | | | |
|---|---|---|---|
| DE | 195 29 044 | A1 | 2/1997 |
| EP | 1 113 147 | A2 | 7/2001 |
| EP | 1 267 045 | A1 | 12/2002 |
| EP | 1 267 046 | A1 | 12/2002 |
| FR | 1 163 535 | A | 9/1958 |

(Continued)

OTHER PUBLICATIONS

Office Action mailed Mar. 29, 2011, in Japanese Patent Application No. 2007-175032 (with English language translation).

*Primary Examiner* — Thomas Denion
*Assistant Examiner* — Daniel Bernstein
(74) *Attorney, Agent, or Firm* — Oblon, Spivak, McClelland, Maier & Neustadt, L.L.P.

(57) ABSTRACT

A lash adjuster includes a plunger inserted into a body and defining a pressure chamber in the body, and a spacer. The plunger is moved axially when a working fluid flows into or out of the pressure chamber so that a volume of the pressure chamber is increased or reduced. The plunger has a bottom wall defining the pressure chamber, a peripheral wall rising from an outer periphery of the bottom wall and an outer peripheral surface having an annular groove located at a height position confined in a thickness range of the bottom wall. When fitted in the groove, the spacer has a plate width equal to a separating distance between a groove bottom and an inner peripheral face of the body to fill a gap between the body and the plunger. The spacer has a flow path through which the working fluid introduced into the pressure chamber leaks.

8 Claims, 5 Drawing Sheets

FOREIGN PATENT DOCUMENTS

| | | |
|---|---|---|
| JP | 56-163604 | 12/1981 |
| JP | 56-163605 | 12/1981 |
| JP | 56-163607 | 12/1981 |
| JP | 56-163608 | 12/1981 |
| JP | 59-137310 | 9/1984 |
| JP | 61-37408 | 3/1986 |
| JP | 2-286814 | 11/1990 |
| JP | 10-504865 | 5/1998 |
| JP | 2001-65702 | 3/2001 |
| JP | 2001-132415 | 5/2001 |
| JP | 2002-285807 | 10/2002 |
| JP | 2004-278377 | 10/2004 |
| JP | 2005-240810 | 9/2005 |

* cited by examiner

LASH ADJUSTER AND VALVE APPARATUS

CROSS-REFERENCE TO RELATED APPLICATION

The present application claims the benefit of patent application number 2007-175032, filed in Japan on Jul. 3, 2007, the subject matter of which is hereby incorporated herein by reference.

BACKGROUND OF THE INVENTION

The present invention relates to a lash adjuster.

JP-A-2004-278377 discloses a lash adjuster and a valve apparatus of a background art. The lash adjuster includes a body and a plunger in a cylindrical shape. A pressure chamber is defined between the body and a bottom portion of the plunger inserted into the body by increasing or reducing a volume of the pressure chamber by a working fluid introduced into the pressure chamber. The plunger is moved in an axial direction, and a valve clearance in a valve apparatus of an internal combustion engine is automatically adjusted. A gap between an inner peripheral face of the body and an outer peripheral face of the plunger is constituted by a small clearance for leaking the working fluid from the pressure chamber. When the plunger is moved to a lower side relative to the body and the working fluid in the pressure chamber is compressed, the working fluid in the pressure chamber flows out of the pressure chamber by passing the small clearance, and a total length of the lash adjuster is slightly shortened.

The small clearance is required to be controlled highly accurately in order to ensure a performance of the lash adjuster. However, there is a situation that the control of the gap between the inner peripheral face of the body and the outer peripheral face of the plunger is technically difficult and productivity is poor. Particularly, a further deterioration in the productivity is concerned when it is necessary to further narrow the gap between the inner peripheral face of the body and the outer peripheral face of the plunger by a request for downsizing the lash adjuster.

BRIEF SUMMARY OF THE INVENTION

The invention has been accomplished based on the above-described situation and it has an object to improve a productivity by facilitating a gap control.

The present invention provides a lash adjuster comprising a body in a cylindrical shape. The plunger is inserted into the body and defining a pressure chamber in the body when assembled to the body. The plunger is moved in an axial direction in the body when a working fluid flows into or out of the pressure chamber so that a volume of the pressure chamber is increased or reduced. The plunger has a bottom wall defining the pressure chamber, a peripheral wall rising from an outer periphery of the bottom wall and an outer peripheral surface formed with an annular groove located at a height position confined in a range of a thickness of the bottom wall out of an outer peripheral surface of the peripheral wall. A spacer is formed into a shape of an annular plate with elasticity and fittable into the annular groove of the plunger. When the spacer is fitted in the annular groove, the spacer has a plate width that is equal to a separating distance between a groove bottom of the annular groove and an inner peripheral face of the body thereby to fill a gap between an inner peripheral face of the body and an outer peripheral face of the plunger. The spacer has a flow path through which a working fluid introduced into the pressure chamber leaks.

According to the above-described lash adjuster, the spacer having a large control width is made to handle a gap control, and therefore, different from the background art, it is not necessary to strictly control a gap between the inner peripheral face of the body and an outer peripheral face of the plunger, the gap control is facilitated, and promotion of a productivity can be achieved.

The invention also provides a valve apparatus comprising a cam rotated by being transmitted with a power of an engine; a rocker arm pivoted with rotation of the cam; a cylinder head including a feeding path along which a working fluid flows and recessed to be formed with a support hole at an upper face thereof and opened with an oil feeding port intersected with the filling path at an inner peripheral face of the support hole; and a lash adjuster of automatically adjusting a valve clearance of a valve inserted to the cylinder head, wherein the lash adjuster comprises a body in a cylindrical shape inserted into the support hole of the cylinder head; a plunger pivotably supporting the rocker arm at an upper end portion thereof, inserted into the body, and defining a pressure chamber in the body when assembled to the body, the plunger being moved in an axial direction in the body when a working fluid flows into or out of the pressure chamber so that a volume of the pressure chamber is increased or reduced, the plunger having an outer peripheral surface formed with an annular groove; and a spacer formed into a shape of an annular plate with an elasticity and fittable into the annular groove of the plunger, wherein when the spacer is fitted in the annular groove, the spacer has a plate width that is equal to a separating distance between a groove bottom of the annular groove and an inner peripheral face of the body thereby to fill a gap between an inner peripheral face of the body and an outer peripheral face of the plunger, and the spacer has a flow path through which a working fluid introduced into the pressure chamber leaks.

BRIEF DESCRIPTION OF THE DRAWINGS

Embodiments 1 through 5 specifying the invention will be explained in reference to the drawings as follows.

DETAILED DESCRIPTION

Embodiment 1

Figure 1:
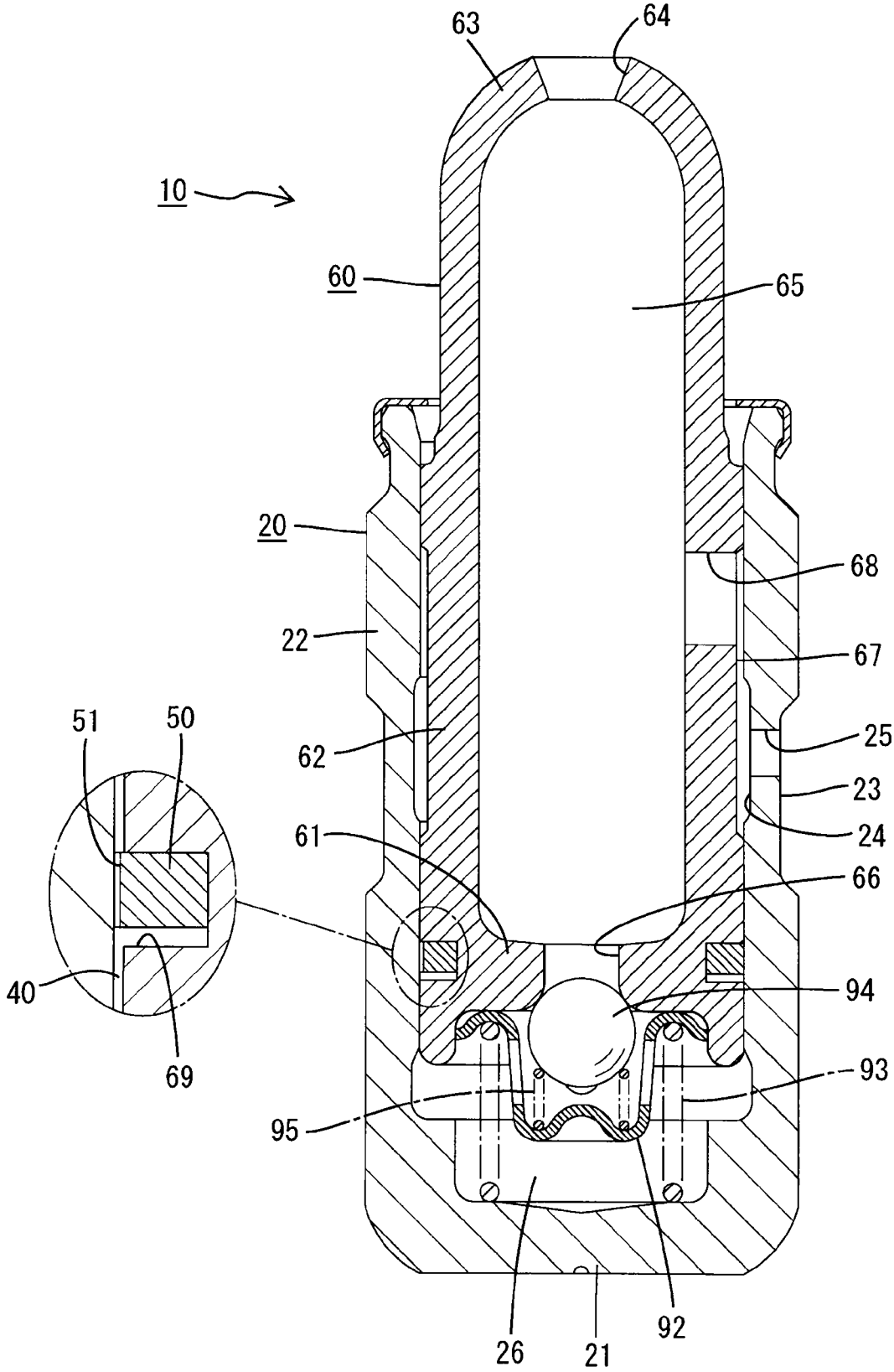
FIG. 1 is a vertical sectional view of a lash adjuster according to the invention.
Figure 2:
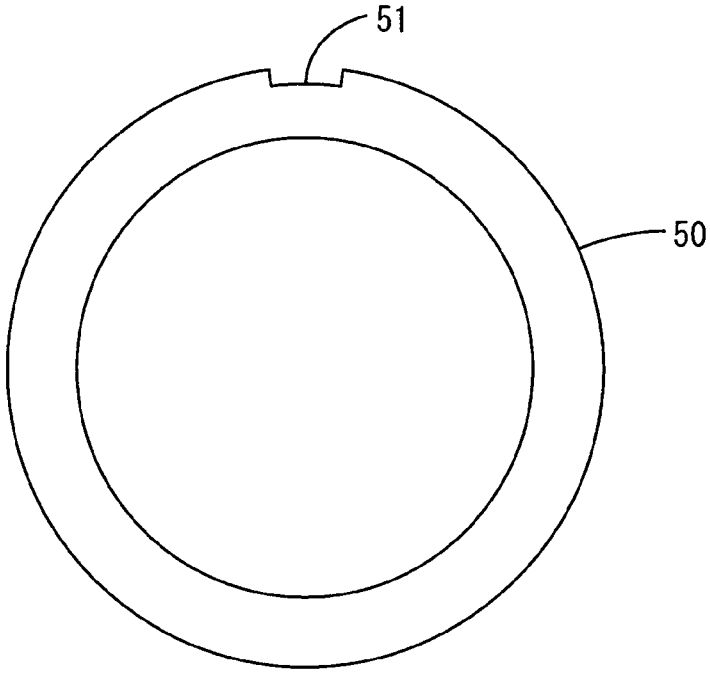
FIG. 2 is a plane view of a spacer of Embodiment 1.
Figure 7:
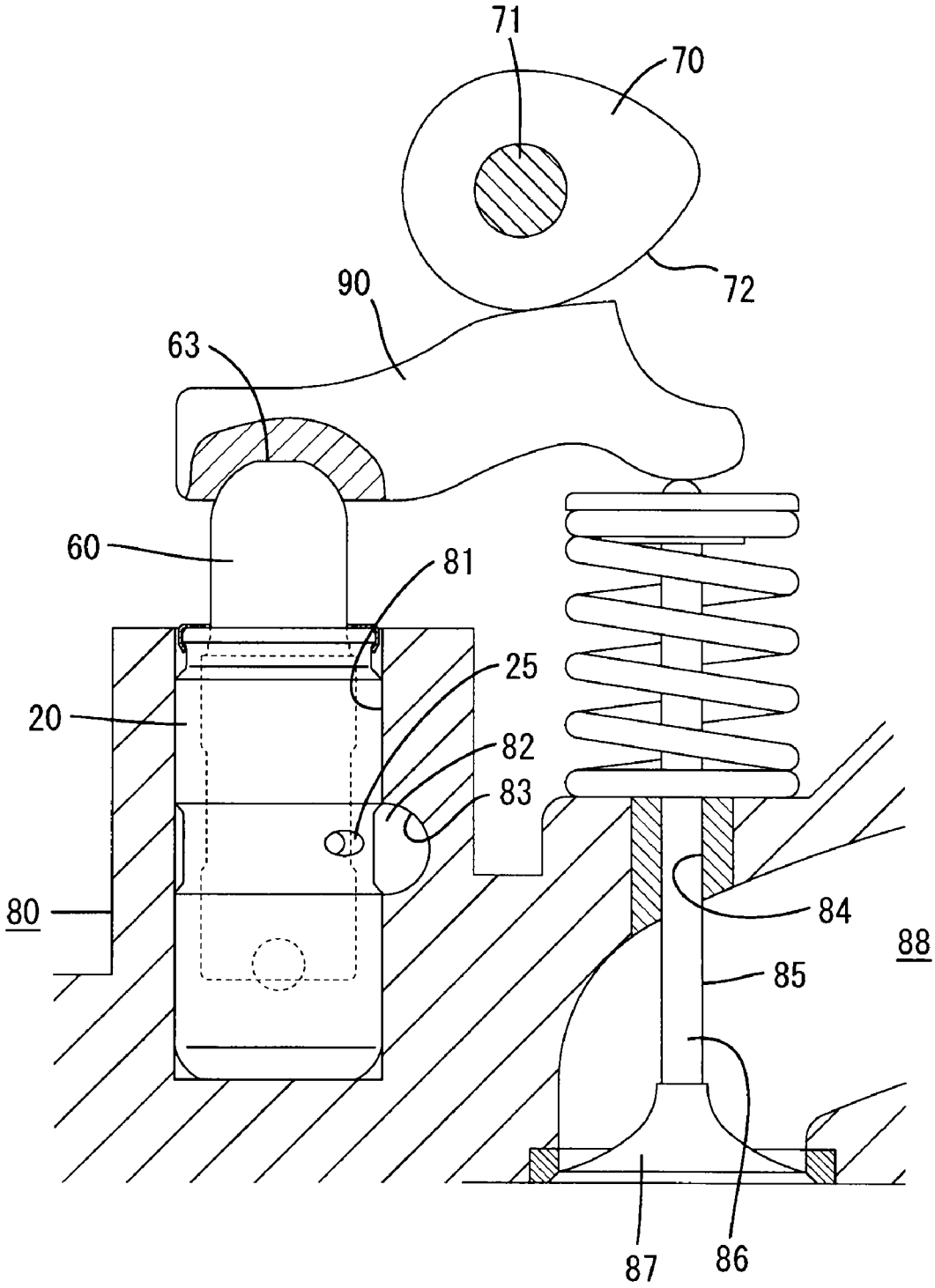
FIG. 7 is a vertical sectional view of a valve apparatus of the invention.

A lash adjuster 10 of Embodiment 1 details of which are shown in FIG. 1, FIG. 2 and FIG. 7 is a lash adjuster of a hydraulic type for pivotably supporting a rocker arm 90 in an axial direction (up and down direction), including a body 20 and a plunger 60 made of a metal.

As shown by FIGS. 1 and 7, the body 20 constitutes a shape of a bottomed cylinder raising a cylinder portion 22 of a shape of a circular cylinder from a peripheral edge of a bottom portion 21 in a circular shape and is attachably and detachably inserted to a bottomed support hole 81 recessed to be formed at an upper face of a cylinder head 80 attachably and detachably while directing an axis core thereof in a depth direction (up and down direction) thereof. An inner peripheral face of the support hole 81 is opened with an oil feeding port 83 intersected with a feeding path 82 of the cylinder head 80. A stem hole 84 of the cylinder head 80 is inserted with a valve stem 86 of a valve 85 movably in an axial direction, and a valve portion 87 provided at a front end of the valve stem 86 opens and closes an intake path 88 at inside of a cylinder, not illustrated.

An outer peripheral face of the cylinder portion 22 of the body 20 is formed with an outer side recess portion 23 over an entire periphery thereof at a position opposed to the oil feeding port 83, further, an inner peripheral face of the cylinder portion 22 of the body 20 is formed with an inner side recess portion 24 in a constrained shape over an entire periphery thereof at a position opposed to the outer side recess portion 23. Further, the cylinder portion 22 of the body 20 is bored with a body hole 25 opened to the outer side recess portion 23 and the inner side recess portion 24.

On the other hand, the plunger 60 constitutes a shape of a bottomed cylinder raising a peripheral wall 62 in a shape of a circular cylinder from a peripheral edge of a bottom wall 61 in a circular shape, fitted to the body 20 and is made to be movable in an axial direction (up and down direction) while bringing an outer peripheral face thereof into sliding contact with an inner peripheral face of the body 20. An upper end portion (top portion) of the plunger 60 is formed with a support portion 63 in a semispherical shape engaged with and supporting one end portion of the rocker arm 90 and the support portion 63 is formed with a vertical hole 64 capable of supplying a working fluid to the rocker arm 90.

An inner portion of the plunger 60 is made to constitute a lower pressure chamber 65 surrounded by the bottom wall 61 and the peripheral wall 62, and an inner portion of the body 20 includes a high pressure chamber 26 between the bottom portion 21 and the bottom wall 61 of the plunger 60 (in correspondence with a pressure chamber of the invention). A center of the bottom wall 61 is formed with a communicating hole 66 for communicating the lower pressure chamber 65 and the high pressure chamber 26.

The high pressure chamber 26 is integrated with a retainer 92, the retainer 92 is pressed to a lower face of the bottom wall 61 of the plunger 60 by an urge force of a retainer spring 93 brought into contact with the bottom portion 21 of the body 20. Further, inside of the high pressure chamber 26 is provided with a check valve 94 in a spherical shape for opening and closing the communicating hole 66, and a valve spring 95 is interposed between the check valve 94 and the retainer 92. The check valve 94 is constituted to be normally urged to an upper side by the valve spring 95 and to be opened only when a hydraulic pressure in the lower pressure chamber 65 is elevated more than a hydraulic pressure in the high pressure chamber 26.

A position of the outer peripheral face of the plunger 60 opposed to the inner side recess portion 24 of the body 20 is formed with a recess portion 67 over an entire periphery thereof. Further, the peripheral wall 62 of the plunger 60 is formed with a plunger hole 68 for communicating the lower pressure chamber 65 and the recess portion 67 on an upper side of the body hole 25.

Now, the outer peripheral face of the peripheral wall 62 of the plunger 60 is formed with a ring-like groove 69 over an entire periphery thereof. The ring-like groove 69 is installed at a height position on a lower side of the recess portion 67 and confined in a range of a thickness of the bottom wall 61. Further, the outer peripheral face of the peripheral wall 62 of the plunger 60 is mounted with one spacer 50 fitted to the ring-like groove 69.

In details, the spacer 50 is constituted as a plate in a shape of a circular ring made of a synthetic resin having heat resistance and predetermined elasticity of fluororesin (ethylene tetrafluoride (PTFE)) or the like. The spacer 50 is interposed in a gap between the inner peripheral face of the cylinder portion 22 of the body 20 and the outer peripheral face of the peripheral wall 62 of the plunger 60 in a compressed state while being fitted to the ring-like groove 69, whereas in a single product state, the spacer 50 is provided with a plate width of a dimension slightly larger than a separating distance between a groove bottom of the ring-like groove 69 and the inner peripheral face of the cylinder portion 22 of the body 20, in an integrated state, the spacer 50 is provided with a plate width of a dimension the same as the separating distance. Further, the inner peripheral face of the cylinder portion 22 of the body 20 and the outer peripheral face of the peripheral wall 62 of the plunger 60 are opposed to each other in parallel by being spaced apart from each other by a small clearance 40 therebetween in a state of interposing the spacer 50 between the two faces.

Further, the spacer 50 is notched to be formed with a flow path 51 for leaking a work fluid introduced into the high pressure chamber 26. The flow path 51 is constituted by notching a portion of an outer peripheral edge of the spacer 50 by a small amount in a rectangular shape, and the working fluid at inside of the high pressure chamber 26 is made to be able to flow out to the upper side by only passing the flow path 51. The opening dimension of the flow path 51 is determined in correspondence with an individual one of the lash adjuster 10.

Next, an operation of the lash adjuster 10 according to the embodiment will be explained. A portion of the working fluid flowing in the feeding path 82 is introduced into the lash adjuster 10 by successively passing the oil feeding port 83, the body hole 25, and the plunger hole 68 and is stored at inside of the lower pressure chamber 65 and the high pressure chamber 26. Further, when a cam 70 is rotated along with a cam shaft 71 transmitted with a power of an engine and the rocker arm 90 is pressed from an upper side by a cam nose 72, the plunger 60 is moved to a lower side relative to the body 20 by being pressed by the rocker arm 90, the working fluid flowing into the high pressure chamber 26 is compressed and a pressure in the high pressure chamber 26 is elevated. In accordance with elevation of the pressure in the high pressure chamber 26, a small amount of the working fluid in the high pressure chamber 26 is moved up to meander through the gap between an inner peripheral face of the cylinder portion 22 of the body 20 and the outer peripheral face of the peripheral wall 62 of the plunger 60, passes through the flow path 51 of the spacer 50 and the small clearance 40, thereafter, made to flow into the lower pressure chamber 65 by way of the plunger hole 68. An entire length of the lash adjuster 10 is shortened slightly by an amount of the working fluid flowing out from inside of the high pressure chamber 26. Further, by elevating the pressure in the high pressure chamber 26, the body 20 and the plunger 60 are integrated to be rigid and the lash adjuster 10 functions as a fulcrum of the operation of the rocker arm 90.

When the cam nose 72 is brought into a state of being directed to the upper side from a lowermost point in accordance with rotation of the cam 70, a force of pressing the rocker arm 90 is nullified, and the plunger 60 is pressed back to the upper side by the pressure in the high pressure chamber 26 and the urge force of the retainer spring 93. When the pressure in the high pressure chamber 26 is lowered to be lower than the pressure in the lower pressure chamber 65 in accordance with movement of the plunger 60 to the upper side, the check valve 94 is opened against the urge force of the valve spring 95, the working fluid introduced into the lower pressure chamber 65 flows into the high pressure chamber 26 by passing the communicating hole 66 and the entire length of the lash adjuster 10 is expanded. By the operation of expanding the lash adjuster 10, a gap is prevented from being brought about between the support portion 63 of the plunger 60 and the rocker arm 90.

According to Embodiment 1, by interposing the spacer 50 between the inner peripheral face of the cylinder portion 22 of the body 20 and the outer peripheral face of the peripheral wall 62 of the plunger 60 and making the working fluid in the high pressure chamber 26 flow out from the flow path 51 provided at the spacer 50, the gap control is handled by the spacer 50 having a large control width, and therefore, different from the background art, the gap between the inner peripheral face of the cylinder portion 22 of the body 20 and the outer peripheral face of the peripheral wall 62 of the plunger 60 may not be controlled strictly and promotion of a productivity can be achieved. As a result, the lash adjuster 10 can be downsized.

Particularly, the flow path 51 is formed at the spacer 50 made of a synthetic resin, and therefore, a working performance of the flow path 51 is facilitated and a dimensional accuracy of the flow path 51 can be promoted in comparison with a case of being formed at the body 20 or the plunger 60 made of a metal. In this case, only one flow path 51 is formed at the spacer 50, and therefore, the dimensional accuracy is further improved.

Further, the ring-like groove 69 for fitting the spacer 50 is provided at a position in correspondence with the bottom wall 61 of the plunger 60, and therefore, the groove depth is not particularly restricted by the thickness of the peripheral wall 62, for example, the groove bottom face can also be disposed on the side of the bottom wall 61, and a degree of freedom of design is improved.

Embodiment 2

Figure 3:
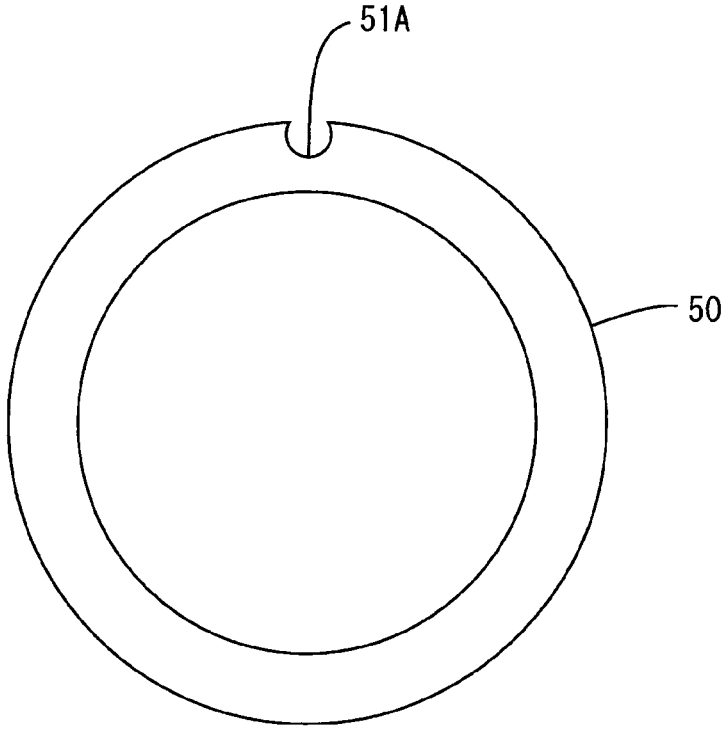
FIG. 3 is a plane view of a spacer of Embodiment 2.

FIG. 3 shows the spacer 50 of Embodiment 2 of the invention. Although Embodiment 2 differs from Embodiment 1 in a mode of a flow path 51A of the spacer 50, Embodiment 2 is the same as Embodiment 1 in constitutions of the spacer 50, the lash adjuster 10, and the valve apparatus excluding the flow path 51A. The flow path 51A of the spacer 50 in Embodiment 2 is formed by notching a portion of an outer peripheral edge of the spacer 50 in a circular arc shape, in details, in a shape of a true circular arc exceeding a semicircle.

EMBODIMENT 3

Figure 4:
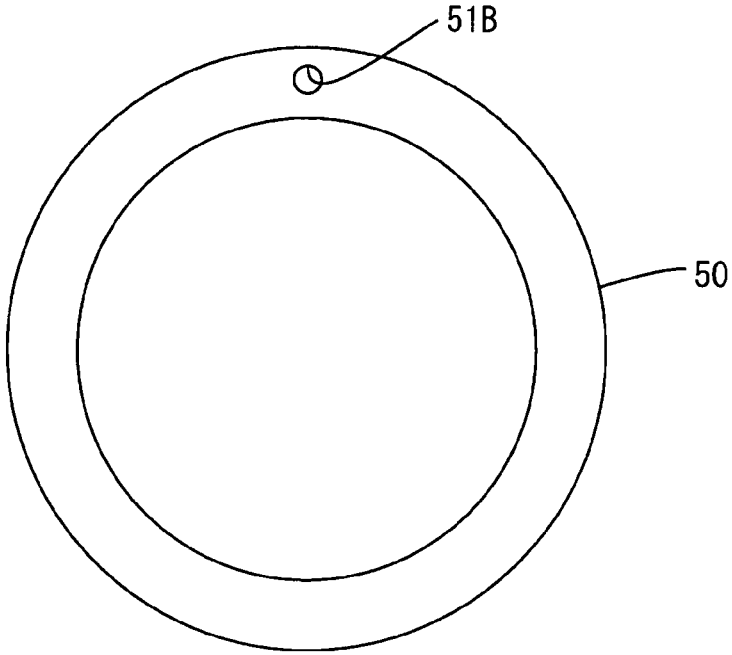
FIG. 4 is a plane view of a spacer of Embodiment 3.

FIG. 4 shows the spacer 50 of Embodiment 3 of the invention. Although Embodiment 3 differs from Embodiment 1 in a mode of a flow path 51B of the spacer 50, Embodiment 3 is the same as Embodiment 1 in constitutions of the spacer 50, the lash adjuster 10, and the valve apparatus excluding the flow path 51B. The flow path 51B of the spacer 50 of Embodiment 3 is formed by penetrating a portion of the spacer 50 in a circular shape, in details, in a shape of a true circle. The flow path 51B constituted as such an orifice hole is easy to achieve a dimensional accuracy.

Embodiment 4

Figure 5:
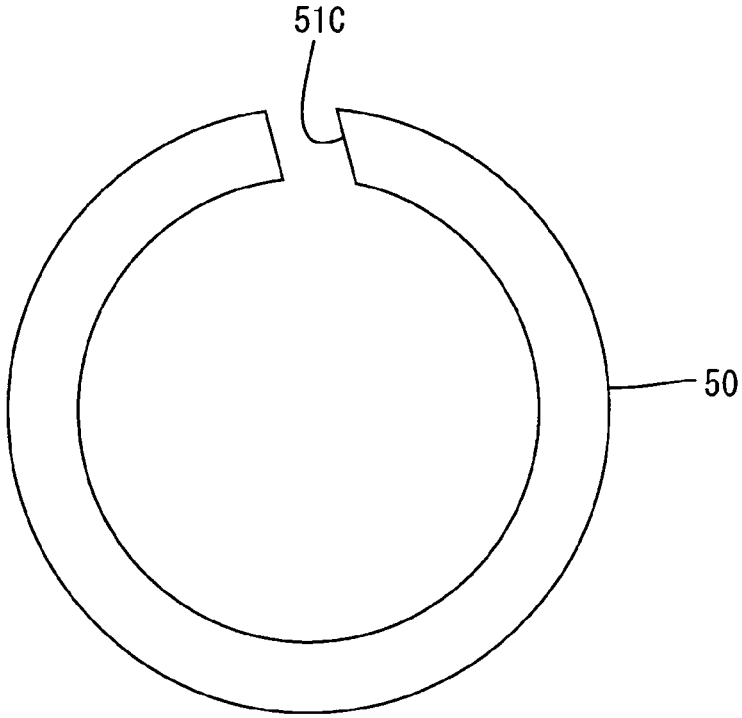
FIG. 5 is a plane view of a spacer of Embodiment 4.

FIG. 5 shows the spacer 50 of Embodiment 4 of the invention. Although Embodiment 4 differs from Embodiment 1 in a mode of a flow path 51C of the spacer 50, Embodiment 4 is the same as Embodiment 1 in constitutions of the spacer 50, the lash adjuster 10, and the valve apparatus excluding the flow path SiC. The flow path 51C of the spacer 50 of Embodiment 4 is formed by cutting to remove a portion of the spacer 50 over an entire width thereof. Thereby, the spacer 50 is constituted by a shape of a character of C as a whole, and therefore, by expanding or contracting a groove width of the flow path 51C constituting a cut portion of the character of C, in comparison with a case of an O ring described above, an error in integrating to between the body 20 and the plunger 60 is easy to be absorbed. In this case, the spacer 50 is not limited to a synthetic resin material but can use a spring member made of a metal. Further, in this case, by utilizing thermal expansion of a material constituting the spacer 50, the groove width of the flow path 51C can be widened at low temperatures and narrowed at high temperatures, and therefore, a flow rate of the working fluid passing the flow path 51C can be maintained substantially constant in a state of a low fluidity at low temperatures and a state of a high fluidity at high temperatures. Further, although the flow path 51C of the spacer 50 shown in FIG. 5 is extended in a skewed direction relative to a diameter direction of the spacer 50, the embodiment is not limited thereto but the flow path 51C may be extended in the diameter direction of the spacer 50.

Reference Example

Figure 6:
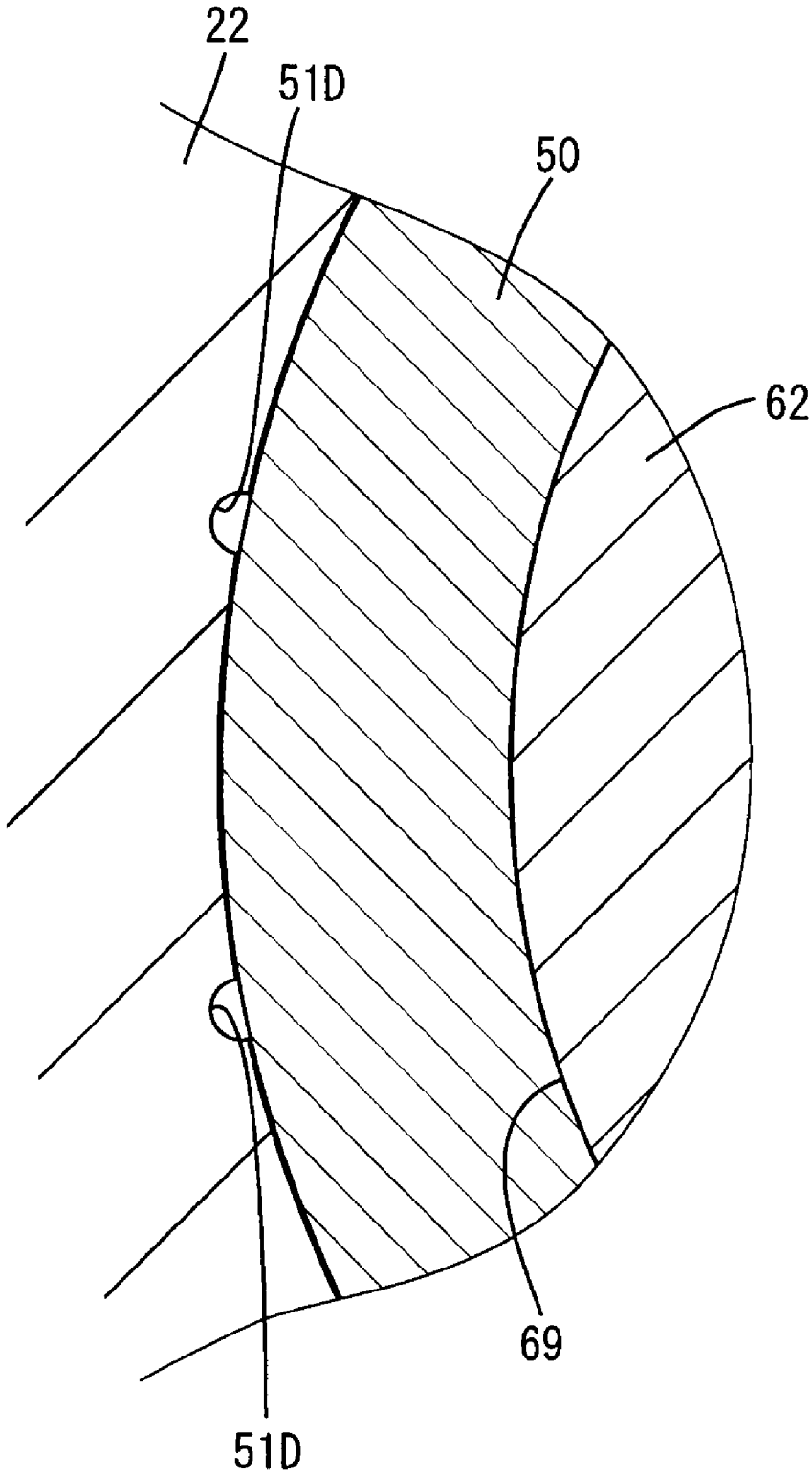
FIG. 6 is a cross-sectional view enlarging a portion of a body formed with a flow path in a reference example.

FIG. 6 shows a reference example of the invention. A flow path 51D of the reference example is provided not in the spacer 50 but in the inner peripheral face of the cylinder portion 22 of the body 20. In details, the flow path 51D in a shape of a semicircular groove extended in a height direction and communicating with the small clearance 40 is formed at a position of the inner peripheral face of the cylinder portion 22 opposed to the spacer 50, a plurality of the flow paths 51D are arranged in the peripheral direction at intervals, and individual flow paths 51D are opened by small amounts. The spacer 50 of the reference example constitutes a shape of a true circular ring as a whole and is not provided with a cut portion, a notch, a hole or the like.

Otherwise, the flow path may be provided at the outer peripheral face of the peripheral wall 62 of the plunger 60, or may be provided by penetrating the bottom wall 61 of the plunger 60 partitioning the high pressure chamber 26 and the low pressure chamber 65. In this way, with regard to a mode of installing the flow path, a certain latitude may be provided to a variation, and therefore, by selecting a pertinent mode in accordance with a situation, a function characteristic of the lash adjuster 10 can sufficiently be achieved.

Further, a plurality of rectangular flow paths may be notched to be formed in an outer peripheral edge of a spacer.

Further, various modes of the flow paths of Embodiments 1 through 4 may mixedly be utilized such that a rectangular flow path and a circular flow path are mixedly provided to the outer peripheral edge of the spacer.

The invention is applicable to an internal combustion engine of a gasoline engine, a diesel engine or the like.

The invention claimed is:

1. A lash adjuster comprising:

a body in a cylindrical shape;

a plunger inserted into the body and defining a pressure chamber in the body when assembled to the body, the plunger being moved in an axial direction in the body when a working fluid flows into or out of the pressure chamber so that a volume of the pressure chamber is increased or reduced, the plunger having a bottom wall defining the pressure chamber, a peripheral wall rising from an outer periphery of the bottom wall and an outer peripheral surface formed with an annular groove located at a height position confined in a range of a thickness of the bottom wall out of an outer peripheral surface of the peripheral wall; and a spacer formed into a shape of an annular plate with elasticity and fittable into the annular groove of the plunger, wherein when the spacer is fitted in the annular groove, the spacer has a plate width that is equal to a separating distance between a groove bottom of the annular groove and an inner peripheral face of the body thereby to fill a gap between an inner peripheral face of the body and an outer peripheral face of the plunger, and the spacer has a flow path through which a working fluid introduced into the pressure chamber leaks.

2. The lash adjuster according to claim 1, wherein the flow path is a single flow path which is formed in the spacer.

3. The lash adjuster according to claim 1, wherein the spacer is made of a synthetic resin.

4. The lash adjuster according to claim 1, wherein the spacer is a spring member comprising a plate made of a metal, and the flow path is formed by cutting out a portion of the spacer over an entire width thereof.

5. The lash adjuster according to claim 1, wherein the flow path is formed by cutting out an outer peripheral edge of the spacer.

6. The lash adjuster according to claim 1, wherein the flow path comprises a circular through hole formed through the spacer.

7. A valve apparatus comprising:

a cam rotated by being transmitted with a power of an engine;

a rocker arm pivoted with rotation of the cam;

a cylinder head including a feeding path along which a working fluid flows and recessed to be formed with a support hole at an upper face thereof and opened with an oil feeding port intersected with the feeding path at an inner peripheral face of the support hole; and a lash adjuster of automatically adjusting a valve clearance of a valve inserted to the cylinder head;

wherein the lash adjuster comprises:

a body in a cylindrical shape inserted into the support hole of the cylinder head;

a plunger pivotably supporting the rocker arm at an upper end portion thereof, inserted into the body, and defining a pressure chamber in the body when assembled to the body, the plunger being moved in an axial direction in the body when a working fluid flows into or out of the pressure chamber so that a volume of the pressure chamber is increased or reduced, the plunger having a bottom wall defining the pressure chamber, a peripheral wall rising from an outer periphery of the bottom wall and an outer peripheral surface formed with an annular groove located at a height position confined in a range of a thickness of the bottom wall out of an outer peripheral surface of the peripheral wall; and a spacer formed into a shape of an annular plate with an elasticity and fittable into the annular groove of the plunger, wherein in a state where the spacer is fitted in the annular groove, the spacer has a plate width that is equal to a separating distance between a groove bottom of the annular groove and an inner peripheral face of the body thereby to fill a gap between an inner peripheral face of the body and an outer peripheral face of the plunger, and the spacer has a flow path through which a working fluid introduced into the pressure chamber leaks.

8. The valve apparatus according to claim 7, wherein the flow path is a single flow path which is formed in the spacer.

* * * * *